US009044637B2

(12) United States Patent
Karl

(10) Patent No.: US 9,044,637 B2
(45) Date of Patent: Jun. 2, 2015

(54) BELT FOR A TREADMILL AND TRAINING EQUIPMENT HAVING A BELT

(75) Inventor: Mueller Karl, Roggwil (CH)

(73) Assignee: Kybun AG, Roggwil (CH)

( * ) Notice: Subject to any disclaimer, the term of this patent is extended or adjusted under 35 U.S.C. 154(b) by 77 days.

(21) Appl. No.: 13/256,862

(22) PCT Filed: Mar. 31, 2010

(86) PCT No.: PCT/EP2010/054293

§ 371 (c)(1),
(2), (4) Date: Sep. 15, 2011

(87) PCT Pub. No.: WO2010/118956

PCT Pub. Date: Oct. 21, 2010

(65) Prior Publication Data

US 2012/0021875 A1 Jan. 26, 2012

(30) Foreign Application Priority Data

Apr. 15, 2009 (DE) ..... 10 2009 017 083
May 4, 2009 (DE) ..... 10 2009 019 482

(51) Int. Cl.
*A63B 22/02* (2006.01)
*A63B 22/00* (2006.01)

(52) U.S. Cl.
CPC ..... *A63B 22/0235* (2013.01); *A63B 22/0023* (2013.01); *A63B 22/0285* (2013.01); *A63B 2022/0228* (2013.01); *A63B 2225/62* (2013.01)

(58) Field of Classification Search
USPC ..... 474/250, 259; 482/54
See application file for complete search history.

(56) References Cited

U.S. PATENT DOCUMENTS

| | | | | |
|---|---|---|---|---|
| 3,641,601 | A | 2/1972 | Sieg | |
| 3,689,066 | A * | 9/1972 | Hagen | 482/54 |
| 4,749,181 | A | 6/1988 | Pittaway | |
| 5,018,722 | A | 5/1991 | Whitmore | |
| 6,084,027 | A * | 7/2000 | Riazi | 524/590 |
| 6,180,210 | B1 * | 1/2001 | Debus | 428/167 |
| 2007/0298937 | A1 | 12/2007 | Shah | |
| 2011/0152038 | A1 * | 6/2011 | Freitag | 482/54 |

FOREIGN PATENT DOCUMENTS

| | | | |
|---|---|---|---|
| DE | 19922822 | A1 | 7/2000 |
| DE | 10133863 | A1 | 2/2003 |
| DE | 102007053655 | A1 | 5/2009 |
| JP | H03261487 | | 11/1991 |
| JP | 2008220467 | | 9/2008 |
| WO | 98/13109 | | 2/1998 |
| WO | 2009/059722 | | 5/2009 |

* cited by examiner

*Primary Examiner* — William E Dondero
*Assistant Examiner* — Robert T Reese
(74) *Attorney, Agent, or Firm* — Davis & Bujold, P.L.L.C.; Michael J. Bujold

(57) ABSTRACT

A belt for a treadmill includes a carrier belt and a tread surface arranged on the carrier belt. The tread surface has pockets which are separate from one another. The pockets are filled, or can be filled, with a filler material.

11 Claims, 2 Drawing Sheets

BELT FOR A TREADMILL AND TRAINING EQUIPMENT HAVING A BELT

BACKGROUND OF THE INVENTION

The present invention relates to a belt for a treadmill and training equipment as described below.

Belts for treadmills or training devices are known from the prior art.

DE 101 33 863 A1 discloses a belt for a treadmill, which has an unevenly formed surface, so that the foot does not tread monotonously during running, but rather must adapt to changing conditions. The uneven surface can be provided with an easily compressible layer to obtain an easy-to-clean and level surface. In addition, different underlying surfaces can be simulated by chambers filled with sand or gel-type material. The training effect is thus to be increased.

WO 98/13109 A1 discloses a belt for a treadmill having a cushioned layer. The cushioned layer has projections which extend transversely over the belt. In order to protect the cushioned layer or the projections from excessively rapid wear, the surface thereof is coated with an abrasion-resistant film. The cushioned layer has the effect in particular that the training is thus to preserve the joints better than typical treadmills.

DE 199 22 822 B4 discloses a training device having a belt which receives lamellae implemented as transverse struts. The tread surface on which the athlete treads via the plurality of transverse struts is curved. The radius of curvature of the tread surface approximately corresponds to the radius which the legs describe during the running movement. The runner therefore does not have to compensate for up-and-down movements or execute jumping movements. In addition, both the lamellae and also the belt are elastically deformable, so that the joint-preserving effect is reinforced still further.

WO 2009/059722 A1 discloses a treadmill which is equipped with a belt, which has a thick cushioned layer. On the one hand, the cushioned layer damps the shocks which act on the joints during running and, on the other hand, it is used to intensify the training effect. Since the foot of the training person sinks deeply into the cushioned material upon each step, the foot must be raised in each case during running, before the next step can be executed. In addition, a training device is disclosed which has a controller of the drive, in order to optimize the training effect with the aid of training and recovery microintervals.

If the treadmill is used by different persons, in particular of different weights, the underlying surface does not always have the ideal properties. In particular, the known belts have the disadvantage that they cannot be refitted for different running properties. In addition, high expansion forces may occur in the redirection area after filling of the chambers, which can result in damage.

SUMMARY OF THE INVENTION

It is the object of the invention to overcome the disadvantages of the prior art. In particular, individual adaptation of the tread surface to the performance, the weight, and the desired degree of comfort of the athlete is to be made possible. The belt is to be easily producible and mechanically durable.

This object is achieved by a belt which has the features described and claimed below.

A belt according to the invention for a treadmill for training the human body comprises a carrier belt and a tread layer situated on the carrier belt. The tread layer has multiple chambers, which are filled or fillable with a filler material. The chambers form separate pockets, which are situated separately from one another on the carrier belt.

A treadmill is understood here and hereafter as a training device, in which the athlete performs running movements on a type of "conveyor belt", both the training device and also the athlete remaining fixed in place. The "conveyor belt" is accordingly referred to as a belt.

A pocket is understood here and hereafter as a device which makes it possible to receive various materials. The pocket can be implemented as a tube, having two diametrically opposing open sides, or can be implemented as closed or closable on all sides. The separation of each individual pocket on the carrier belt is of particular significance, whereby optimum flexibility of the belt is ensured overall.

The carrier belt primarily serves for the mechanical stability of the belt. Designs of treadmills are conceivable where the belt absorbs the entire weight of the runner, so that special requirements are placed on the stability of the carrier belt. Alternatively, the treadmill can have a load-bearing unit below the belt in the running area of the athlete. The belt therefore no longer has to absorb the entire weight of the runner. The design of the carrier belt can be adapted accordingly. Due to the design having underlying load-bearing unit, it can be advisable if the carrier belt has a sliding layer on the side thereof facing toward the load-bearing unit, which minimizes the friction resistance between belt and load-bearing unit. Alternatively, the load-bearing unit can also be equipped with rollers. Both the carrier belt and also the tread layer can be optimized for the respectively required properties through the embodiment having carrier belt and tread layer.

The pockets are situated on the carrier belt so that they are separated from one another and have no common side walls. The pockets are formed from a material which is easily deformable and only insignificantly influences the property of the material located in the pockets. The tread surface is formed by the top side of the pockets. The care, in particular with respect to hygiene, can be simplified by suitable selection of the material of the pocket. A material which is easily washable and disinfectable is preferably used for this purpose. For example, the pocket can comprise a plastic film. Films made of rubber, latex, or a polyvinyl chloride-polyurethane mixture (PVC/PU) are conceivable for this purpose. The film preferably comprises approximately 97% PVC and approximately 3% PU. Other materials are also conceivable. Filled pockets allow the properties of the tread layer to be intentionally influenced and, for example, belts to be provided for different requirements. Through a fillable design of the pockets, they may be filled on location and thus the property of the tread layer can be adapted in accordance with the requirements of the user.

The pockets can be removably situated on the carrier belt. For example, the pockets can be fixed on the carrier belt by sewing, welding, and/or gluing. Through a removable type of fastening, simple replacement of worn-out pockets or replacement of pockets which are filled with other materials is made possible. Therefore, on the one hand, maintenance work is simplified and, on the other hand, the individual adaptability of the properties of the tread surface is made still simpler. Removable connections can for example be implemented using snap fasteners, hook-and-loop closures, etc.

At least one pocket can be filled with multiple materials having different properties. The characteristics of the tread layer may thus be influenced once again. For example, one pocket can be equipped with a soft underlay and a harder layer located thereon. The soft layer ensures that the tread on the tread surface is damped and thus preserves joints, while the harder layer lying above it ensures stability of the treading foot.

At least two filled pockets of the tread layer can also have different properties. Running on such a belt is thus particularly attractive, the musculature of the athlete is not loaded monotonously but rather must adapt itself to various conditions.

The tread layer of the belt can have multiple pockets in the running direction and/or transversely to the running direction of the belt. Multiple pockets in the running direction decrease the resistance of the belt during the redirection over redirection rollers, since the milling is reduced. The dimensions of the pockets in relation to a diameter of a redirection roller used in a treadmill are to be considered accordingly. It has thus been shown that the optimum dimensions of the pockets in the running direction are between 0.1 and 1, preferably between 0.2 and 0.8 in relation to the diameter of the redirection roller. The height of the pockets or the thickness of the tread layer is between 1 cm and 10 cm, in particular between 1.5 cm and 8 cm, preferably between 2 cm and 5 cm.

An embodiment of multiple pockets transversely to the running direction allows, for example, the properties of the tread layer to be adapted differently for the right foot or the left foot. This also includes the arrangement of pockets of different heights.

The pockets can also be situated at an angle to the running direction. In addition, the pockets situated transversely to the running direction can be situated offset to one another in the running direction, which allows further variations.

The pockets can be laterally open or closable. Depending on the filler material, this can prevent filler material from being able to escape from the pockets due to use. The pockets can also be laterally closed, in particular welded. This is advantageous in the case of powdered filler material, for example.

The filler material can be selected from the group comprising a cushion filled with a fluid, sand, gravel, rock, wood, cork, and/or plastic. In addition, the filler material can have different shapes, in particular powders, granules, balls, ellipsoids, cylinders, cubes, cuboids, and/or rods. Further materials and shapes of the filler material are conceivable.

The filler material can also be a foamed plastic, preferably a foamed polyurethane. Both open-pored and also closed-pored variants having their different properties are usable.

The foamed plastic can be compressible between 40% and 95% with an area of 10 cm×10 cm and a surface load of 1000 N, for example.

Training equipment according to the invention for training the muscles of the human body required during running on a tread surface has an endless carrier belt circulating in one direction over two redirection rollers rotatable around axes parallel to one another, the tread surface for training being associated with the upper run thereof on the upper side of the carrier belt facing away from the redirection rollers. At least one of the two redirection rollers has a drive controlled via a controller. A load-bearing unit, which is immobile in relation to the training equipment, is associated with the lower side of the upper run of the carrier belt facing toward the lower run. In addition, the carrier belt has a yielding layer made of plastic on the upper side thereof facing away from the redirection rollers, the yielding layer being provided with a skin and with valleys, which extend from the free outer side of the layer in the direction toward the upper side thereof, while leaving webs. The skin is guided in the area of the valleys up to the upper side of the carrier belt and fixed there to form pockets. The plastic comprises individual rods and each pocket is filled using at least one of the rods. Each rod preferably has a greater height of the valleys, measured perpendicularly to the upper side of the carrier belt, than the spacing of two valleys adjacent to one another, which establishes the width.

Through the formation of the skin having the stable, laterally open pockets, which are stationary in relation to the upper side of the carrier belt, a plastic can be used therein, which is more elastically yielding, softer, and additionally thicker because of the greater height than the width of the pockets, e.g., injected or in the form of rods, which does not have to have great intrinsic stability and lower elasticity connected thereto, but also allows deep spring deflection. The pockets can be implemented as laterally open or closed.

According to the invention, the weight of the human body of the training person is thus absorbed by the load-bearing unit and dissipated into the training equipment. It is thus in turn possible, using the endlessly circulating carrier belt having the thick, elastically yielding, soft plastic, to simulate a natural surface, into which one sinks rapidly and deeply, so that it is necessary at the beginning of the next step to first raise the foot by the sunken mass in order to be at the level of the free outer side again at all. Thereafter, the foot must be raised again and moved forward to end the next step. A setting to the respective condition of the training person and/or the training goal is possible through the controller of the drive.

Using the training equipment according to the invention, not only is sinking into sand or a similar natural surface simulated, but rather also a higher force expenditure is required on the same section in the direction of the carrier belt and/or other muscle groups are trained by the deep sinking and thus a better training result is achieved.

In the training equipment according to the invention, each rod can be enveloped by the skin completely and/or while leaving laterally open pockets, and the skin can be fixed, e.g., glued and/or welded on, in the contact area on the upper side of the carrier belt to form the pockets.

It has proven to be preferable if the thickness and/or the resilience of the layer of the training equipment is dimensioned so that upon loading by the human body it is compressible in the thickness thereof by 40% to 95%, preferably 50% to 90%, and very particularly preferably 60% to 80%.

In order to protect at least the outer side of the layer against damage and/or sweat, the preferably viscoplastic skin, which serves as the actual tread surface, is associated with the free outer side of the plastic. In this case, this skin can be at least partially materially bonded, e.g., glued, to the free outer side of the plastic.

In order to also simulate inclines as a training effect, at least one of the axes of the two redirection rollers can advantageously be implemented to be raised or lowered perpendicularly to the extension thereof, e.g., by means of an electrically operated threaded rod or the like.

Furthermore, it is advantageously possible using the controller of the training equipment according to the invention to drive the drive rapidly or more slowly in relation thereto in individually settable, alternating training microintervals and successive recovery microintervals of various lengths, the training microintervals being able to be between 8 and 40 seconds, preferably between 9 and 35 seconds, and very particularly preferably between 10 and 30 seconds, and the recovery microintervals being able to be between 13 and 90 seconds, preferably between 14 and 75 seconds, and very particularly preferably between 15 and 60 seconds.

Also, if the thick, elastically yielding, soft layer is a volume filled with air, the pressure thereof can also be set controlled by the drive so it is optionally changing, so that the surface can also artificially simulate, for example, hard wet sandy ground as on the beach or soft pine needle ground as in the forest.

It is thus possible using the controller of the training equipment according to the invention to simulate practically any training terrain having uphill and downhill slopes, training and recovery sections, and optionally having hard and soft ground.

In the training equipment according to the invention, each rod can be enveloped by the skin completely or while leaving laterally open pockets and the skin can be fixed in the contact area on the upper side of the carrier belt to form the pockets.

The rods can be implemented as round, semi-elliptical, semicircular, rectangular, or trapezoidal in cross-section.

At least a part of the rods can comprise at least two partial rods, which are flatly connected to one another, and the plastics of the partial rods can have varying resilience or elasticity.

The layer can have an elastically yielding, soft plastic.

The plastic can be implemented as a foamed plastic and open-pored and/or (partially) close-pored.

The layer can be from 2 to 10 cm, preferably 2.5 to 8 cm, and very particularly preferably 1.5 to 6 cm thick.

The layer can be compressible in the thickness thereof upon loading by the weight of the human body by 40% to 95%, preferably 50% to 90%, and very particularly preferably by 60% to 80%.

The valleys can be narrow in relation to the width of the webs measured in the direction of the circulating carrier belt.

The valleys can be narrower in relation to the width of the webs measured in the direction of the circulating carrier belt by a factor of 3 to 15, preferably 6 to 14, and very particularly preferably 8 to 13.

The valleys can extend parallel to the two axes of the rotatable redirection rollers.

The valleys can extend at an angle in relation to the upper side of the carrier belt.

The valleys can extend at a right angle in relation to the upper side of the carrier belt.

The valleys can end at a distance from the two outer edges of the upper side of the carrier belt, which are situated spaced apart in extension of the axes of the redirection rollers.

A skin used as the actual tread surface can be associated with the free outer side of the plastic.

The skin can be implemented as viscoplastic.

The skin can be materially bonded to the free outer side of the plastic or can be implemented as a separate tread surface belt, which rests on the free outer side and circulates therewith, and which is redirected via separate redirection rollers.

At least one of the axes of the two redirection rollers can be implemented so it can be raised or lowered perpendicularly to the extension thereof.

The controller can drive the drive rapidly or more slowly in relation thereto in individually settable, alternating training microintervals and successive recovery microintervals of various lengths.

The training microintervals can be between 8 and 40 seconds, preferably between 9 and 35 seconds, and very particularly preferably between 10 and 30 seconds.

The recovery microintervals can be between 13 and 90 seconds, preferably between 14 and 75 seconds, and very particularly preferably between 15 and 60 seconds.

DESCRIPTION OF THE DRAWINGS

The invention is explained in greater detail hereafter on the basis of figures, which solely illustrate exemplary embodiments. In the figures.

DETAILED DESCRIPTION OF THE INVENTION

Figures 1A, 1B, 1C:
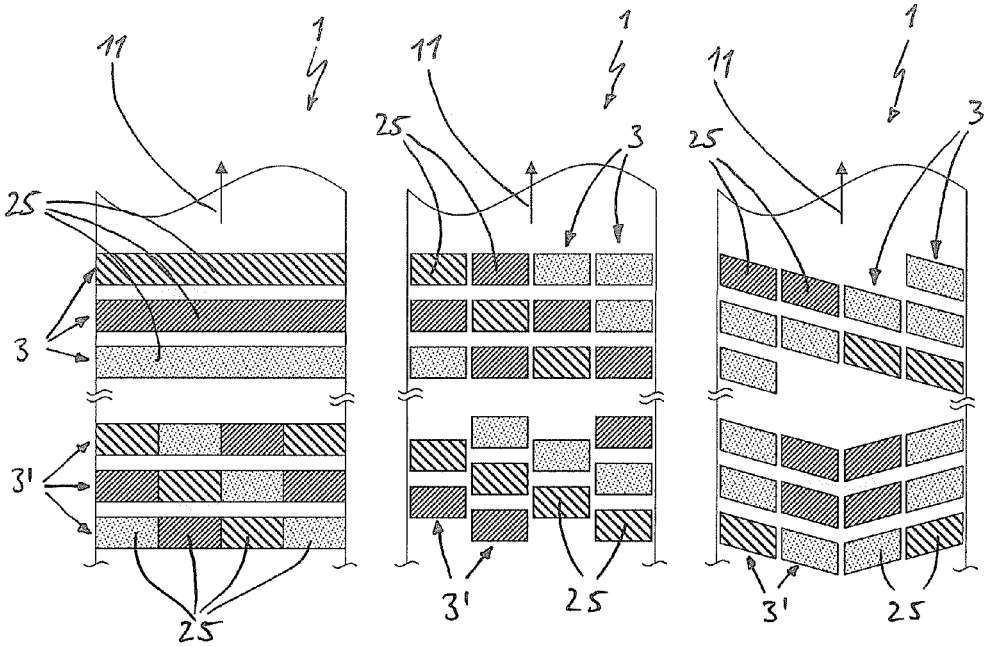
FIG. 1*a* shows a schematic illustration of a belt according to the invention having multiple differently filled pockets in the running direction.
FIG. 1*b* shows a schematic illustration of a belt according to the invention having multiple differently filled pockets both in the running direction and also transversely to the running direction.
FIG. 1*c* shows a schematic illustration of a belt according to the invention having a plurality of differently filled pockets situated at an angle to the running direction.

FIG. 1*a*) to 1*c*) show, in a top view, schematic illustrations in various embodiments of a belt 1 according to the invention having multiple differently filled pockets 3 in the running direction 11. The belt 1 is only shown partially and is provided in each case with two different arrangements of pockets 3.

In FIG. 1*a*), each pocket 3, 3' is continuous and spans more or less the entire width of the belt 1. Each of the upper three pockets 3 in the illustration is filled using only one filler material 25 over the width of the belt 1 in each case. The lower three pockets 3' in the illustration are each filled using different filler materials 25 in the width thereof. In the exemplary embodiment shown, the pockets 3' have four different filler materials 25 situated adjacent to one another. However, any other number of filler materials 25 can also be used. In addition, it is also conceivable that instead of filler materials 25 situated adjacent to one another transversely to the running direction 11, these can also be situated adjacent to one another in the running direction 11 or even one on top of the other.

FIG. 1*b*) correspondingly shows an arrangement having differently filled pockets 3, 3', multiple pockets 3, 3' being situated both in the running direction 11 and also transversely to the running direction 11. The upper three rows of pockets 3 in the illustration are situated oriented adjacent to one another and spaced apart. The lower pockets 3' in the illustration are situated laterally offset adjacent to one another and spaced apart. The filling of the pockets 3, 3' with filler material 25 can be performed arbitrarily. All pockets 3, 3' can be filled with the same filler material 25 or with filler material 25 having different properties. Fillings corresponding to FIG. 1 are also possible. The different fillings can be combined into arbitrary patterns.

FIG. 1*c*) shows a belt 1 in which the pockets 3, 3' are situated at an angle to the running direction 11. The pockets 3 can each be at an angle in one direction. However, it is also possible that the pockets 3' first run in one direction and then change the direction. Arbitrary pocket profiles are therefore conceivable. The filling with different filler materials 25 corresponds to the possibilities according to FIGS. 1*a*) and 1*b*).

Figure 2:
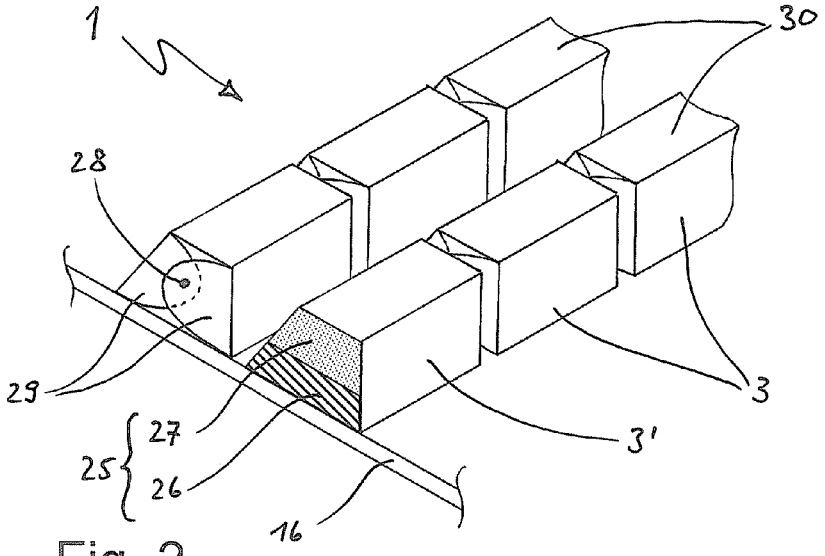
FIG. 2 shows a perspective detail view of a belt according to the invention having multiple filled and closed pockets, one pocket being shown open.

FIG. 2 shows a detail view of a belt 1 having multiple pockets 3, 3' situated on a carrier belt 16. The pockets 3 are filled and closed, the pocket 3' is shown open. The pockets 3, 3' are situated as in the upper illustration of FIG. 1*b*). Other arrangements are also possible.

The pockets 3 each have two closure elements 29 laterally, which are closed using a snap fastener 28. The filler material 25 therefore cannot escape laterally even upon intensive use of the belt 1. The closure elements 29 are manufactured from the same material as the pocket 3 itself. In the exemplary embodiment shown, the closure elements 29 are integrally connected to the pocket 3 and protrude like wings on both sides of the pocket 3. Of course, other shapes and designs of the closure elements are also conceivable. Other elements instead of a snap fastener can also be used for the closing, for example, a hook-and-loop closure. The pockets can also be filled at the factory and permanently closed, in particular welded.

The open pocket 3' is shown without closure elements for the sake of simplicity. The layered construction of the filler material 25 can be seen clearly. The filler material 25 is formed from a lower layer 26 and an upper layer 27. It is obvious that other arrangements of the filler material 25 according to the description of FIG. 1*a*) are also possible.

The tread surface 30, on which the user of the belt 1 stands, is formed by the upper side of the pockets 3, 3'. With suitable selection of the filler material 25, however, the user does not perceive a hard tread surface 30, but rather perceives the entire tread layer 2, which is formed by the filled pockets 3, 3' and the carrier belt 16.

The filled pockets 3, 3' shown have an area of 4 cm×10 cm at a height of 3 cm. The distance between two pockets 3, 3' transversely to the running direction is 0.5 cm. The distance between the pockets 3, 3' in the running direction is 0.2 cm measured at their base or on the carrier belt 16 and 0.5 cm at the height of the tread surface 30 with stretched belt. In another embodiment (see FIG. 1*a*), only one pocket extends over the width of the belt. This pocket has an area of 2 cm×50 cm at a height of 2 cm. The spacing of the pockets in the running direction is identical to the exemplary embodiment shown. However, other dimensions and spacings are also conceivable.

Figure 3:
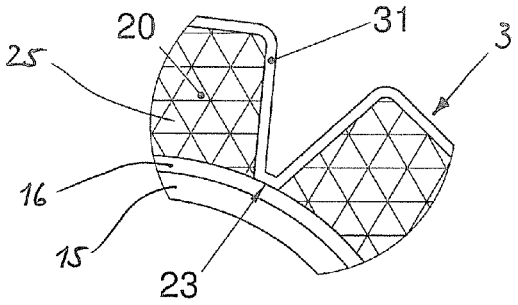
FIG. 3 shows a detail view of a belt according to the invention in the area of a redirection roller.
Figure 4:
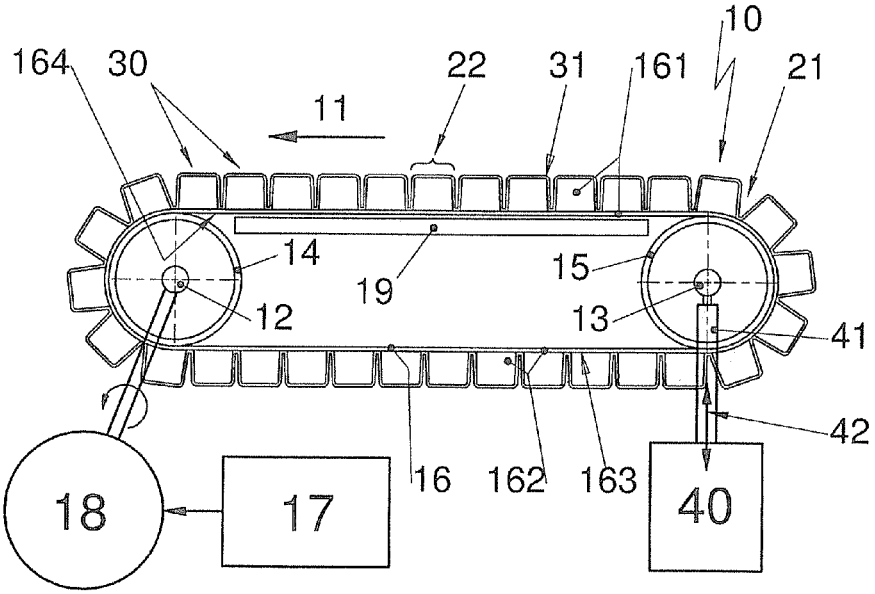
FIG. 4 shows an embodiment of training equipment according to the invention in a side view.

FIG. 3 shows a detail view of the belt in the area of a redirection roller 15 of training equipment 10 implemented as a treadmill (see FIG. 4). The carrier belt 16 can be seen clearly, on which the pockets 3 are situated. The pockets 3 are filled with a filler material 25 in the form of a yielding layer 20. The pocket 3 forms a nonslip skin 31, which holds the layer 20 or the filler material 25 in location and protects it from abrasion. The skin 31 of the pocket 3 is fixed on the carrier belt 16 at the position 23. In the exemplary embodiment shown, the skin 31 is welded to the carrier belt 16. Other fastening possibilities are also conceivable, however, in particular sewing or gluing.

FIG. 4 shows an embodiment 10 of the training equipment according to the invention. It is used for training the muscles of the human body required during running on a tread surface and has an endless carrier belt 16, which circulates in one direction 11 over two redirection rollers 14, 15 rotatable around axes 12, 13 which are parallel to one another, the tread surface 30 for training being associated with the upper run 161 thereof on the upper side 163 of the carrier belt 16 facing away from the redirection rollers 14, 15. Furthermore, a drive 18 controlled by a controller 17 is provided.

A load-bearing unit 19, which is fixed in place on the housing and is immobile in relation to the training equipment 10, is associated with the lower side 164 of the upper run 161 of the carrier belt 16, which faces toward the lower run 162, on which load-bearing unit the upper run 161 can be supported and via which the force resulting from the weight of the human body in the form of the training person can be dissipated.

In order to also simulate inclines as a training effect, one axis 13 of the redirection roller 15 is implemented so it can be raised or lowered perpendicularly to the extension thereof according to the directional double arrow 42 by means of, for example, an electrically operated (40) threaded rod 41 or the like.

On the upper side 163 thereof facing away from the redirection rollers 14, 15, the carrier belt 16 has a plurality of pockets, which are parallel to one another, are formed by a viscoplastic skin 31, and are laterally open in the exemplary embodiment shown, and which are filled using a layer 20 made of a thick, elastically yielding, soft plastic, which is guided in the area of valleys 21 up to the upper side 163 of the belt 16 as the contact area 23 and fixed there to form the pockets, as schematically shown in FIG. 2. The tread surface 30 is associated with the free outer side of the layer.

The layer 20 has valleys 21, which extend from the free outer side thereof in the direction of the upper side 163 of the carrier belt 16 while leaving webs 22, the valleys 21 being narrow in relation to the width of the webs 22 measured in the direction 10 of the circulating carrier belt 16, preferably narrower in relation to the width of the webs measured in the direction of the circulating carrier belt 16 by a factor of 3 to 15, preferably 6 to 14, and very particularly preferably 8 to 13. The valleys 21 extend parallel to the two axes 12, 13 of the rotatable redirection rollers 14, 15. Furthermore, the valleys 21 extend perpendicularly in relation to the upper side 163 of the carrier belt 16 in the exemplary embodiment shown.

The plastic, which is implemented for example as foamed, open-pored and/or (partially) close-pored plastic, comprises individual rods according to the teaching of the invention and each pocket is filled with at least one of the rods, each rod having a greater height of the valleys 21 measured perpendicularly to the upper side 163 of the belt 16 than the spacing of two adjacent valleys which establishes the width, the layer being 2 to 10 cm, preferably 2.5 to 8 cm, and very particularly preferably 1.5 to 6 cm thick or tall and being compressible in the thickness thereof upon loading by the human body by 40% to 95%, preferably 50% to 90%, and very particularly preferably 60% to 80%.

Using the training equipment, it is possible, via the controller 17 of the drive 18 according to the invention as well as the possibility of raising or lowering at least one of the axes 13 of one redirection roller 15 perpendicular to the extension thereof by means of the threaded rod 41, which is electrically driven by the control drive 40, to simulate practically any training terrain having uphill and downhill sections as well as training and recovery sections, optionally having hard and soft ground, using the training equipment according to the invention.

The invention claimed is:

1. A belt for a treadmill for training the human body, said belt comprising a carrier belt and a tread layer situated on the carrier belt, said tread layer comprising multiple chambers, wherein said chambers are constructed from a skin material connected to the carrier belt, said skin material forming separate pockets, which are situated separately from one another on the carrier belt, wherein each of the pockets is constructed as a tube, having two diametrically opposing sides, wherein said two diametrically opposing sides are either open or closable or closed, and wherein each of said pockets is filled with a foamed polyurethane filler material having a compressibility of between 40% and 95% under a load of 1000N applied to an area of 10 cm by 10 cm.

2. The belt according to claim 1, wherein said pockets are removably connected to the carrier belt by fasteners.

3. The belt according to claim 2, wherein said fasteners are snap fasteners or hook-and-loop closures.

4. The belt according to claim 1, wherein at least one pocket is filled with multiple filler materials having different compressibility rates.

5. The belt according to claim 1, wherein at least two filled pockets of the tread layer have different compressibility rates.

6. The belt according to claim 1, wherein the tread layer has multiple pockets in the running direction and/or transversely to the running direction of the belt.

7. The belt according to claim 6, wherein said pockets situated transversely to the running direction are situated offset to one another in the running direction.

8. The belt according to claim 1, wherein said pockets are situated at an angle to the running direction.

9. The belt according to claim 1, wherein the filler material has a shape which is selected from the group consisting of powders, granules, balls, ellipsoids, cylinders, cubes, cuboids, rods, prisms, and mixtures thereof.

10. The belt according to claim 1, wherein the tread layer has a thickness between 2 cm and 5 cm.

11. The belt according to claim 1, wherein said tubes have closures at each end to retain said filler material in the tube.

* * * * *

UNITED STATES PATENT AND TRADEMARK OFFICE

CERTIFICATE OF CORRECTION

PATENT NO. : 9,044,637 B2
APPLICATION NO. : 13/256862
DATED : June 2, 2015
INVENTOR(S) : Karl Mueller It is certified that error appears in the above-identified patent and that said Letters Patent is hereby corrected as shown below:

ON THE TITLE PAGE

Item (12) should read Mueller

Item (75) Inventor should read: Karl Mueller, Roggwil (CH)

Signed and Sealed this
Twenty-fourth Day of November, 2015

Michelle K. Lee

Michelle K. Lee
*Director of the United States Patent and Trademark Office*